US006098937A

United States Patent [19]

Carnahan et al.

[11] Patent Number: 6,098,937

[45] Date of Patent: Aug. 8, 2000

[54] SUPPORT STAND, ASSEMBLY USING THE SAME, AND METHOD OF MAKING THE SAME

[76] Inventors: Garnett Carnahan; Caroline Carnahan, both of 337 E. Lindbergh Rd., Nixa, Mo. 65714

[21] Appl. No.: 09/227,588

[22] Filed: Jan. 8, 1999

[30] Foreign Application Priority Data

Jan. 8, 1998 [CN] China ..... 98 2 23029.X

[51] Int. Cl.[7] ..... F16M 13/00; F16M 11/00; A47C 1/02; A47C 1/00; A47C 1/12

[52] U.S. Cl. ..... 248/158; 248/575; 248/562; 248/161; 297/344.12; 297/344.18

[58] Field of Search ..... 248/158, 160, 248/161, 162.1, 188.1, 188.2, 188.5, 560, 561, 562, 564, 568, 569, 570, 575, 634, 635, 636; 297/344.18, 344.19, 344.12

[56] References Cited

U.S. PATENT DOCUMENTS

| | | | |
|---|---|---|---|
| 3,885,764 | 5/1975 | Pabreza | 248/162.1 |
| 4,580,749 | 4/1986 | Howard | 248/161 |
| 4,842,238 | 6/1989 | Toiyama | 248/562 |
| 4,848,524 | 7/1989 | Hosan et al. | 188/322.17 |
| 5,131,615 | 7/1992 | Hosan et al. | 248/161 |
| 5,149,035 | 9/1992 | Bonnema et al. | 248/188.7 |
| 5,433,409 | 7/1995 | Knopp | 248/161 |
| 5,443,573 | 8/1995 | Thiele et al. | 267/64.12 |
| 5,462,248 | 10/1995 | Bauer | 248/161 |
| 5,511,759 | 4/1996 | DeKraker et al. | 248/575 |

OTHER PUBLICATIONS

1996 Marine Products Catalogue of Springfield Marine Company.

General Information Sheet on Hexcel Uralite Brand Tooling Urethanes of the Kindt–Collins Company.

General Information Sheet on"Specially Urethane Plastics and Elastomers" T.A. Davies Co. (Web Cite page).

*Primary Examiner*—Ramon O. Ramirez
*Assistant Examiner*—Don A Szumny
*Attorney, Agent, or Firm*—Smith, Gambrell & Russell, LLP

[57] ABSTRACT

A support stand, support stand assembly, and method of making the same with the support stand featuring a base with central hub-like reception area either capped or uncapped at its bottom and a supporting rod that has a diameter less than that of the side wall defining the reception area so as to form an annular gap. An elastomer material, which is preferably a liquid urethane that cures at room temperature, is poured into the gap so as to form an energy management member which acts as a flexible cushioning element by helping to dampen and diffuse rocking forces of the supporting rod with respect to the base. The energy management member also acts to glue the supporting rod to the base through the bonding properties.

22 Claims, 5 Drawing Sheets

SUPPORT STAND, ASSEMBLY USING THE SAME, AND METHOD OF MAKING THE SAME

FIELD OF THE INVENTION

The present invention relates to a support stand an assembly using the same and a method of making a support stand having particular utility in assemblies such as a chair or table with support stand. The arrangement of the present invention makes it particularly useful for use on chairs and the like which are in moving transportation usage with the transportation means being subject to a rocking motion such as a ship or a railroad dining car.

BACKGROUND OF THE INVENTION

The conventional stands used for marine chairs, mounted tables and the like are typically composed of a supporting rod and a base-plate with the supporting rod and the base-plate being made of corrosion resisting materials so as to withstand the relatively harsh environments associated with ships at sea and recreational and non-recreational boats on bodies of water. Usually the supporting rod and the base-plate of conventional stands are assembled together through use of a force fit wherein the mating lower end portion of the supporting rod is machined or formed to have a slightly larger diameter or periphery than that of the receiving female reception hole of the base-plate. Assembly is achieved by compressing one or the other or both until the male member is in a force fit connection with the base-plate. These conventional structures have a variety of drawbacks including the following:

1. The stand assembled by the force fit process is a rigidly connected structure, which, particularly under the rocking circumstances encountered by ships, dining rail cars and the like, results in an uncomfortable feel to those who sit in such chairs (chairs in the context of the present invention is meant to have a broad meaning which includes stools and various other sitting devices);
2. The rigid connection leads to high stresses in the joined parts and thus a shorter life span in the device and/or higher costs due to increased strength design and material requirements; and
3. The forced fit process, not only requires more advanced equipment, but also requires that the operators concerned master a certain degree of skill, furthermore a significant amount of energy is required and lots of labor expended in operation, thereby the manufacturing cost is increased.

SUMMARY OF THE INVENTION

The present invention is directed at avoiding many of the problems associated with the prior art by providing a support stand that is relatively low in manufacturing costs, avoids expensive and complex manufacturing equipment, and has a high life expectancy despite usage in a highly dynamic environment such as on a ship or pleasure boat. Further, the design of the present invention is intended to help increase the comfort of a person sitting on a chair when the support stand is used to support a marine chair or the like which is subject to a great deal of rocking motion. This added comfort is provided through use of an energy management layer between the supporting rod and the base member which doubles as an interlocking or adhering component of the invention.

The advantageous features of the present invention stem from the design of the present invention which includes a support stand comprised of a supporting rod and a base plate which, when used in the context of a marine chair support stand, are each formed of a corrosion resistant metal. The lower end of the supporting rod to be received by the receiving section of the base member or plate has an outer diameter (or peripheral area if other than a circular end configuration exists in the supporting rod) which is less than the adjacent surface of the receiving section of the base member so that a space or gap is provided between the two that is preferably, on average, about 0.03 to 1.0 inch, (0.076 to 2.54 cm), more preferably, about 0.0625 to 0.5 of an inch (0.15 to 1.27 cm), and even more preferably, about 0.35 of an inch (0.9 cm.). Thus, a pour mold area is formed between the interior surface of the preferably centralized cup shaped reception area of the base member and the external surface of the undersized supporting rod. Preferably the interior surface of the cup member and the exterior surface of the inserted section of the supporting rod each have a circular cross-section and the supporting rod is centered with respect to the interior surface so as to from a cylindrical mold space in a concentric relationship. However, the mold space between the interior surface of the reception cup and the exterior surface of the supporting rod can also be of different configurations with the cross-sectional configuration of the surfaces defining the mold space preferably being the same, only of a different size. Also the supporting rod's received end is preferably generally centered so that a same width peripheral mold cavity extends about the entire periphery of the internal member.

The relative thickness of the mold cavity preferably is either constant for its entire depth along the axis of elongation of the supporting rod, or one or both of the two adjacent surfaces of the respective members converges or slopes inward toward the other in an up to down direction to a slight degree (e.g., within 10° or more preferably within 5°). In this way, a slightly larger width upper receiving area is provided at the open, top end of the mold cavity.

Preferably, the energy management layer is formed between the exterior surface of the supporting rod and to an internal surface of the base member (e.g., from the standpoint of material savings and avoiding too much flexibility), although other arrangements in accordance with the invention are possible such as a protrusion of the base plate being received in the hollow end of a supporting rod and an energy management layer positioned between the protrusion and the interior surface of the supporting rod with or without an additional energy management layer between the exterior of the supporting rod and an interior surface of a receiving cup. For example, the liquid elastomer can be poured into an annular recess formed by an internal, capped protrusion and the remainder of the base plate external to the capped central protrusion and intermediate annular recess, and the supporting rod inserted so as to have an adhering energy management layer internal and external to the supporting rod.

Within the mold cavity between the supporting rod and the base member is poured a material which is preferably liquid or has or can obtain (e.g., heated polymer beads) a suitable viscosity level that allows the material to flow throughout the cavity and then set up to form a solid elastomeric interface between the supporting rod and base member so as to make for an integral relationship between the supporting rod, the setup, elastomeric layer, and the base member. In a preferred embodiment, the molded elastomeric layer is a polymer that has a low moisture sensitivity (e.g., is essentially waterproof) such as a low moisture urethane elastomer. This material can be formed by mixing two chemical precursors (e.g., polyisocyanate and polyhydric alcohol and any other of the commonly used additives for color, avoiding UV breakdown, etc.) to form the polyurethane intermediate layer.

The poured chemical material preferably cures or sets at room temperature with an ASTM hardness value being preferably about (+/−10) of a preferred value of 85A and 40D. These values provide a high degree of comfort when the support stand is used as a component of a marine chair or the like as the elastic material between the base member and support rod provides an energy management interface. Also, in addition to providing for a comfortable feel, the material also needs to retain its elastic property despite numerous deflections in a harsh environment such as a marine environment. Furthermore, the material utilized also has an adhesive quality to promote an integral relationship between the supporting rod and base plate by adhering one to the other through the poured elastic chemical material. In this way, the poured layer functions as a shock absorbing unit and as an attachment means. The poured layer, because of its adherence to the relative surfaces and the fact that it preferably fills up the entire mold cavity to at least the level of the reception cavity's rim and, in some embodiments, slightly above that level precludes any debris or the like for collecting in the interface area between the reception plate and supporting rod. Also, one or more locking notches, recesses, annular grooves or the like can be provided either on the received exterior surface of the supporting rod or the interior surface of the base reception member or both. Each locking notch is filled in when the liquid elastic precursor material is poured into the mold cavity. Preferably a pair of continuous circular grooves are formed in the interior surface of the base reception member in a spaced apart arrangement along the axis of the receiving hole of the base plate (e.g., 25 % and 75 % down from the top or rim of the receiving hole in the base plate). These grooves provide an added degree of axial locking between the supporting rod and base member so as to further preclude inadvertent separation.

To provide even a more heavy duty arrangement, the typically hollow supporting rod is provided with an internal shaft with a threaded tip. This shaft is fastened to the supporting rod shell and is received through a shaft reception hole formed in a central bottom region of the base member and a nut or the like completes the coupling of the shaft to the base member and hence also provides added securement of the base member to the supporting rod. In a preferred embodiment this shaft represents a vertical extension of an air piston seat adjustment assembly which is precluded from axial separation from the supporting rod, but connected in a manner that can accommodate the flexing nature of the interconnection between the base.

The base-plate is preferably made of corrosion resistant material and, to provide adequate rigidity and strength without increasing the weight of the base-plate, the base-plate is preferably made of cast aluminum with a thin shell structure. The central reception area represents a cup-like or hub portion of the base member and a through-hole or closed bottom recess is formed in the center of the hub portion with the diameter of the through-hole or recess, at least above a lower bottom shoulder portion, being slightly larger than the outer diameter of the supporting rod. In addition, a plurality of strengthening ribs extend from the hub in radial fashion out to the outer edge of the base member. These ribs lessen in thickness in going from the center out, and are integral with a frusto-conical top covering which extends out from the upper rim of the supporting rod reception opening to the circular periphery of the base-plate. Just inward from the peripheral outer edge of the base-plate there is provides a plurality of equidistantly distributed, stepped through-holes. Bolts or the like are passed through the through-holes to fix the stand onto the deck of a supporting surface such as the deck of a ship or boat.

In assembling the support stand of the present invention, the supporting rod and the base-plate are placed on a special jig assembly to make the support rod perpendicular to the bottom plane of the base-plate. The jig also ensures that the gap between the outer diameter of the supporting rod and the interior surface of the hub portion of the base-plate forms an annular shaped pour space concentrically arranged with respect to the hub's interior surface and the exterior of the received portion of the supporting rod (i.e., a cylindrical or essentially cylindrical shaped space). The energy controlling and adhesive elastomer layer is formed by filling the mixed liquid of the elastomeric precursor chemical components into the space. In the preferred use of a polyurethane, the polyurethane layer firmly bonds the supporting rod and the base-plate into an integral unit and also provides energy management means that promotes a comfortable ride when the support stand is used with boat or marine chairs which are subjected to a rocking motion when traveling over waves. The jig features a bottom plate positioner and a support rod positioner which together place the supporting rod in the aforementioned concentric position which promotes an equal distribution of the poured in polymer. As the jig assembly of the present invention features only a few relatively simple, non-energy requiring components, the manufacturing and assembling process can be seen to have obvious advantages as compared with the above described forced fix process.

DETAILED DESCRIPTION OF THE PREFERRED EMBODIMENTS

Figure 1:
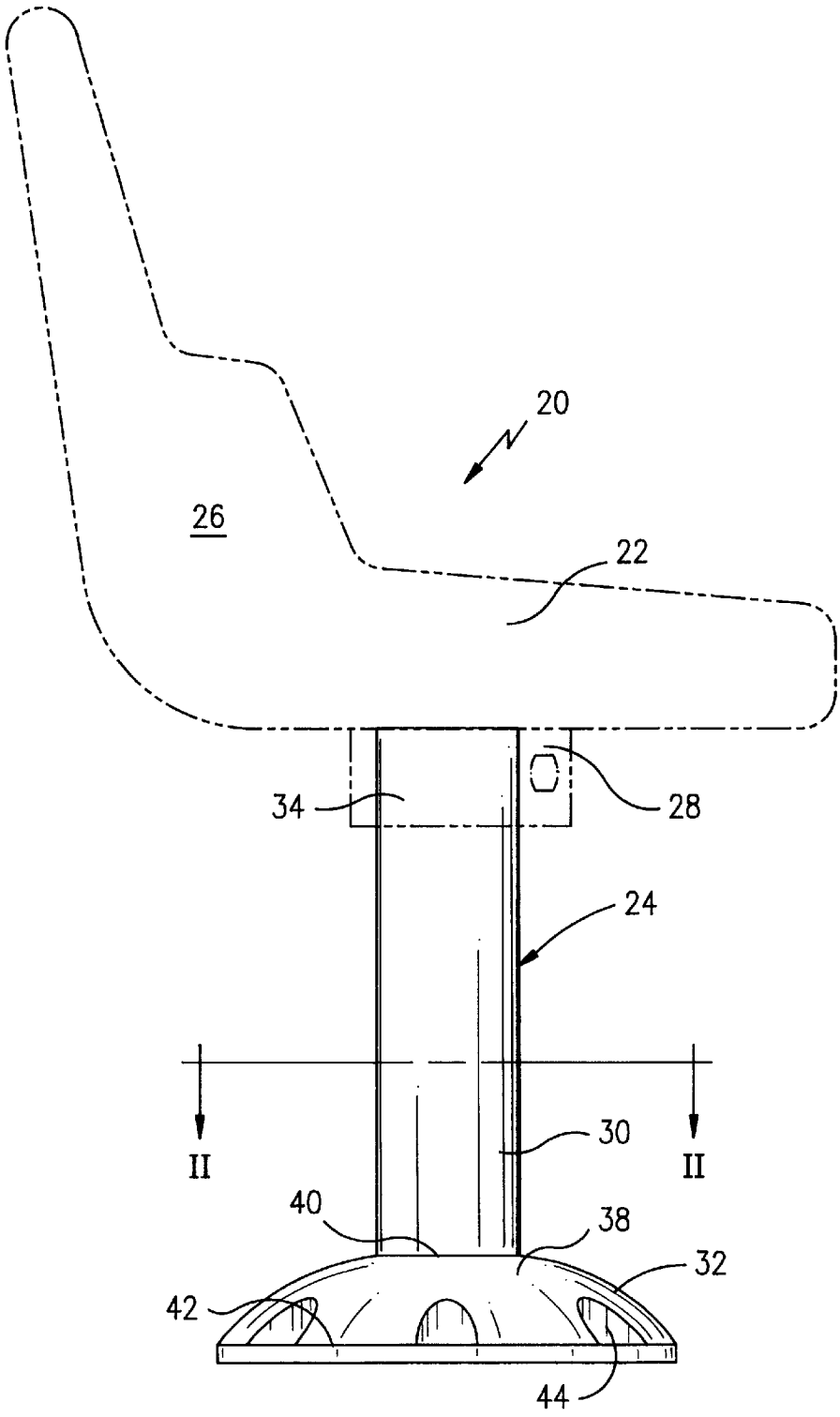
FIG. 1 shows a side elevational view of a support stand assembly of the present invention which includes a support stand and an attached chair seat.

FIG. 1 illustrates a side elevational view of support stand assembly 20 which, for this embodiment, includes chair seat 22 and support stand 24. In the illustrated embodiment, chair seat 22 includes a seat shell 26 with bottom support stand attachment means 28 which, as described in greater detail below can take on a wide variety of forms including a fixed fastener, a rotation attachment, a height adjustment attachment, a horizontal slide attachment (see for example, U.S. Pat. No. 5,704,729, which is incorporated by reference) or any combination thereof. In a preferred embodiment, chair seat 22 is a marine chair seat which is designed to withstand the harsh environment imposed on marine chairs and the like. Chair seat 22 is also shown in broken line fashion to emphasize that the support stand 24 of the present invention can provide support to other components such as a table top, although the support stand of the present invention is particularly well suited for use as a marine chair seat particularly due to its energy management feature as discussed in greater detail below.

Support stand 24 comprises supporting rod 30 and base member 32. Supporting rod 30 has top end 34 connected with attachment means 28 and bottom end 36 (FIG. 3) received within base member 32. In the FIG. 1 embodiment, base member 30 is shown to have a generally dome-shaped upper cover 38 which terminates inwardly at reception rim 40 and outwardly at vertical peripheral edge 42. Extending inwardly from edge 42 are a plurality of fastener clearance recesses 44 which are preferably three or more in number with six equally circumferentially spaced recesses 44 being shown in the embodiment of FIGS. 1–3.

Figure 2:
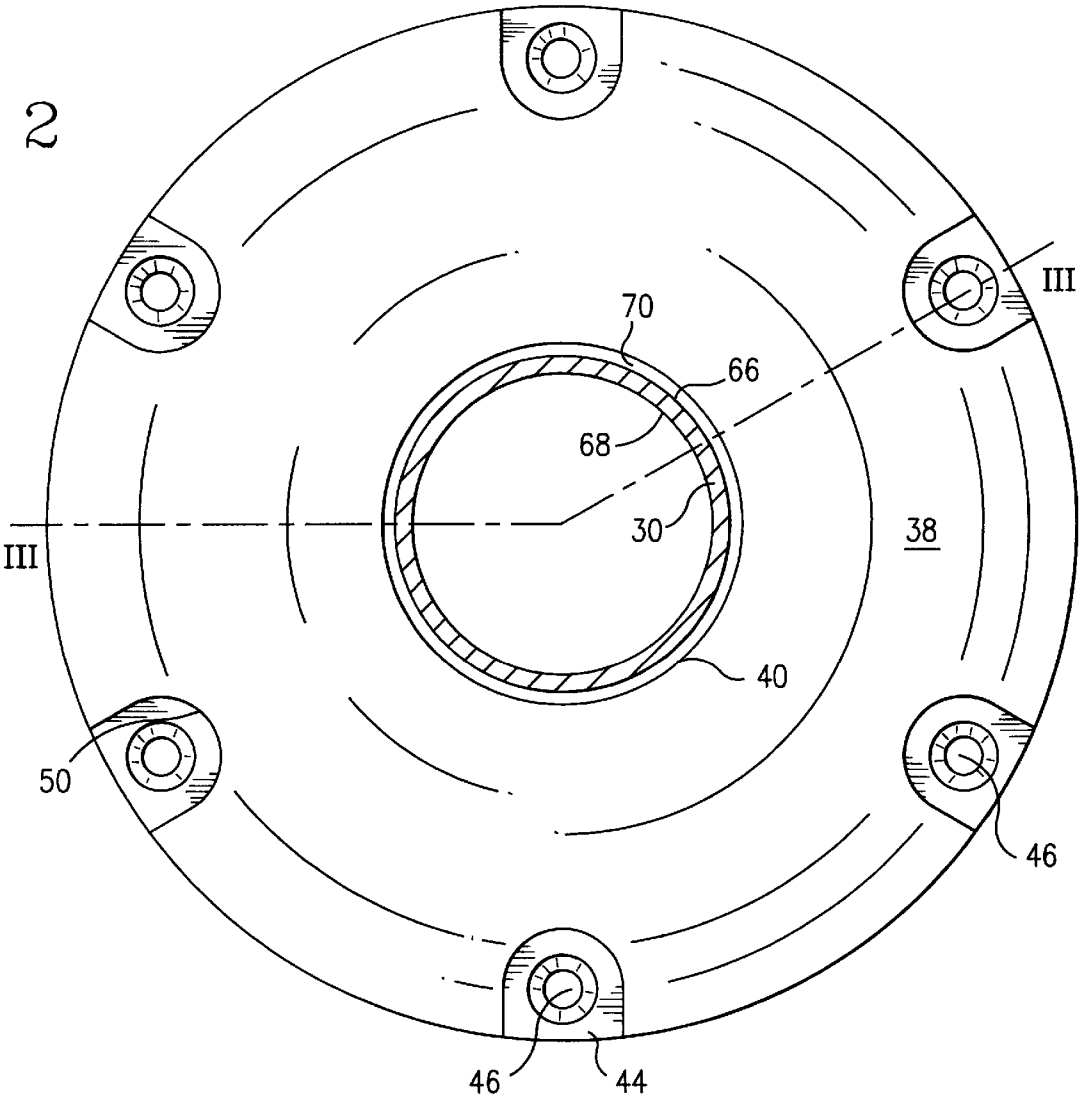
FIG. 2 shows a cross-sectional view of the assembly shown in FIG. 1 taken along cross-section line II—II.
Figure 3:
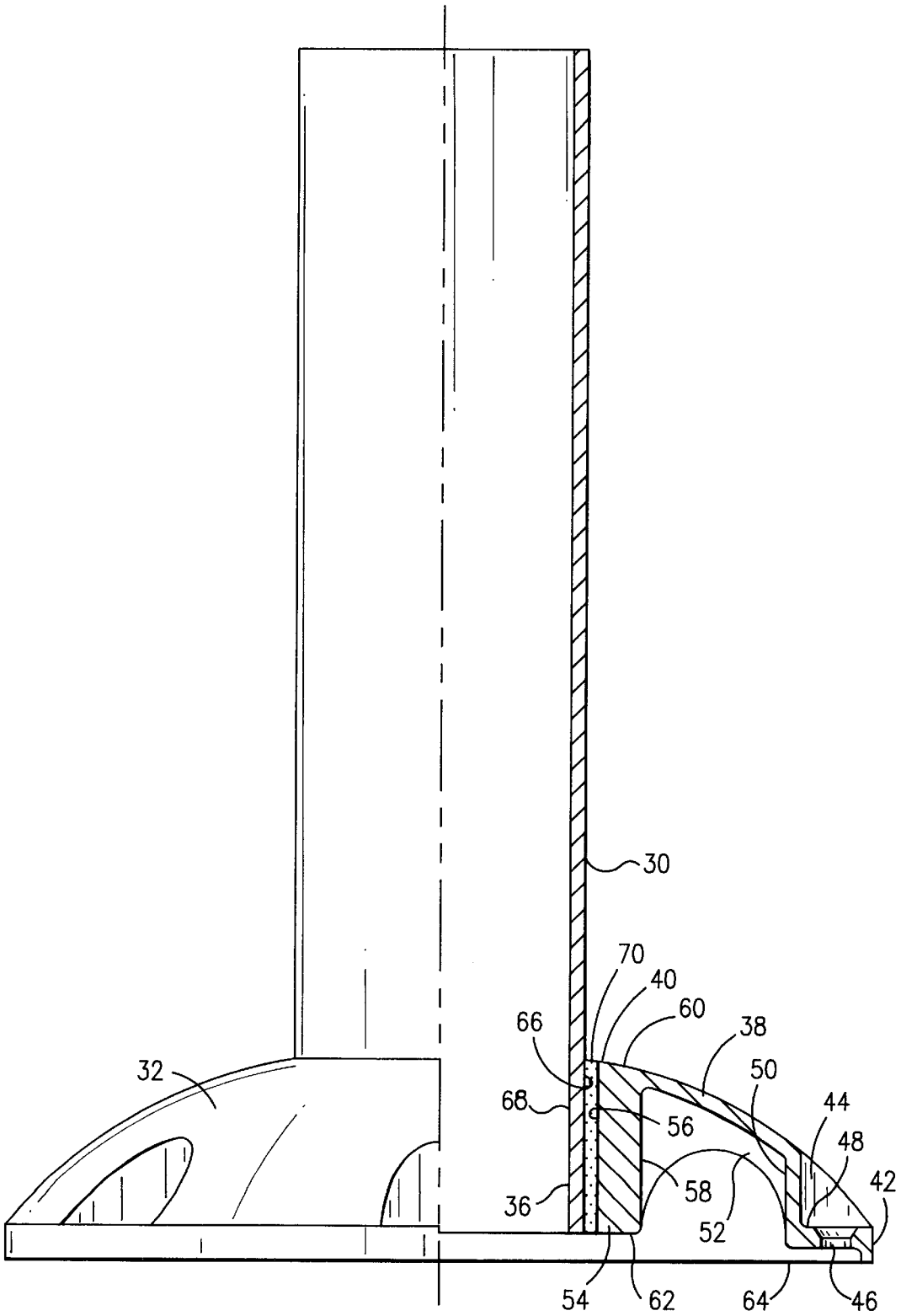
FIG. 3 shows a cross-sectional view of the assembly in FIG. 1 taken along cross-section line III—III in FIG. 2.

As shown particularly in FIGS. 2 and 3, each of fastener clearance recesses 44 has a stepped fastener insertion hole 46 extending through horizontal step 48 which extend radially outward off from a vertical wall 50. Ribs 52 (only one shown in FIG. 3) extend radially inward off from each of vertical walls 50 and are in an integral relationship with those walls. There are preferably an equal number of ribs 52 as recesses 44. Ribs 52 extend inwardly into an integral relationship with hub 54 which is a cylindrical shaped member having interior surface 56 and exterior surface 58. The ribs 52 preferably have a concave or arched under edge and longer connection contact surfaces at the hub and vertical wall interfaces. Hub 54 has an upper end 60 with rim 40 at its inward most point, which rim lies on a horizontal plane, and hub 54 has a curving surface extending radially out from rim 40 and having a common curvature with that of cover 38. Lower end 62 of hub 54 is spaced above the level of underlying surface contact edge 64 so as to provide some clearance between the two when fasteners such as bolts or the like are inserted through holes 46 to force contact edge 64 into a secure, abutting engagement with an underlying surface such as a boat deck. The spacing between bottom edge 62 of supporting rod 30 and contact edge 64 of base member 32 allows for some degree of freedom of movement under the energy management system of the present invention with respect to supporting rod 30 without contact or damage to an underlying surface such as a wood ship deck.

As also shown in FIGS. 2 and 3, supporting rod 30 is preferably in the form of a cylindrical tube with its end 36 received within a reception space defined by the interior surface 56 of hub 54. In FIG. 3, the reception space is shown to be a single diameter through-hole, and tube 30 is shown to have its exterior surface 66 spaced inward from hub surface 56 and its interior tube surface 68 spaced even further inward from hub surface 56. Reception end 36 of tube 30 is shown to extend down into the reception opening of hub 56 but not further than the lower end 62 of hub 54 to maintain a clearance space with respect to the underlying surface. In this way, supporting rod 30 can be placed in an isolated, suspension and energy absorption state as made clearer below.

Since the diameter of the supporting rod exterior surface 66 is less than the diameter of the adjacent, interior surface 56 of hub 54, a gap is formed between these surfaces. This gap is preferably of a continuous width about its periphery (so as to provide a concentric arrangement with respect to the juxtaposed interior and exterior surfaces defining the gap) and, with respect to the embodiment shown in FIGS. 1–3, of equal thickness at all points along its axial length. Within this gap is poured a material that preferably is a liquid having a viscosity level that allows for dispersion over all of the interface regions between the interior surface 56 of base member 32 and which through, for example, liquid/solid surface adhesion and liquid surface tension stays within the gap during the curing period. Upon curing, the poured material provides an elastomeric energy management member which allows for controlled deflection of the supporting rod with respect to the relatively fixed base member so as to provide a high comfort ride when the support stand is used with a marine chair or a like object subjected to a rocking motion in use. The poured elastomeric material must have suitable elasticity as to allow for numerous rocking cycles without losing its adhesion and energy management qualities (e.g., in a preferred embodiment in excess of ½ million cycles of a wave effect approximation machine were performed without disruption of the relationship between the poured material, supporting rod and base plate). Despite its elastic qualities, the material must also have a suitable density, deflection or hardness value, and thickness as to avoid essentially direct contact or essentially a direct passage of abutment forces between a shifting supporting rod and a relatively fixed in position base member. The material is also preferably water resistant and sufficiently UV resistant for use in a preferred marine seat environment.

In a preferred embodiment, the gap, and hence, also the elastomeric spacer, has a radial length or thickness from about 0.03 to 1.0 inch, (0.076 to 2.54 cm), more preferably about 0.0625 to 0.5 of an inch (0.15 to 1.27 cm), and even more preferably about 0.20 to 0.40 (0.5 to 1.0 cm) of an inch. Within these preferred thickness parameters, a suitable elastomeric material is a polyurethane material that satisfies the function criteria set forth above. Preferably, the material used to provide the means for bonding and managing energy in the invention is a liquid cast polyester urethane. Liquid castable polyurethanes are typically a two component liquid system at room temperature which is usually processed by machine dispensing or hand mixing and pouring into a mold. Preferably, the material is supplied in an open cast (the clearance space defining surfaces forming the mold) technique as this avoids complex machinery and high skilled operation and servicing. However, in addition to open casting, the material can also be provided in accordance with other techniques such as rotation molding, spin casting, reaction injection molding (RIM), etc., although, again, the open casting technique is more preferred in the present invention, particularly from the standpoint of ease in application without complex and expensive equipment.

A suitable bonding/energy management material can be found in low moisture Hexcel Uralite® brand tooling urethanes sold by the Kindt-Collins Company of Cleveland, Ohio U.S., particularly the urethanes sold by that company for use as corebox liners and pads and bumpers (e.g., product #'s 3148, 3160, 3162 , 3154 and 3155, with product #3152 being the most preferred). These materials and characteristics of these materials are described in a Kindt-Collins Supply Information Sheet entitled Hexcel Uralite® Brand Tooling Urethanes, which is incorporated by reference for additional background.

Provided below is a table directed at the present invention, which provides preferred ranges and values for the properties of some examples of preferred adhesive/energy management materials useful in the present invention. The characteristics below feature the same ASTM and units as used in the above-identified Supply Information Sheet.

| ITEM | PARAMETER | PREFERRED RANGE | PREFERRED VALUE OR RANGE WITHIN RANGE |
|---|---|---|---|
| 1 | ASTM Shore Hardness | 85 to 95 A<br>35 to 45D | 90A<br>40D |
| 2 | Ratio by weight (precursors A and B) | A = 100<br>20 to 40B | 100A<br>26B |
| 3 | Curing | Room | Room |
| 4 | Gel Time(min) [ASTM D 2671-71] | 20 to 50 | 25 |
| 5 | DeMold Time Hours at 77° F. | 3 to 40 | 4.6 |
| 6 | Viscosity (CPS) | 1,900 to 6,000 | 5,500 |
| 7 | Shrink (in/in) | .001 to .003 | .002 |
| 8 | Tensile Strength (PSI) [ASTM D 412-98] | 2,000 to 3,500 | 2,200 |
| 9 | Elongation % [ASTM D412-98] | 150 to 450 | 210 |
| 10 | Tear Strength | 250 to 500 | 302 |
| 11 | Operating Temperature Range ° F. | 90 to 200 | 130 to 160 |

Figure 4:
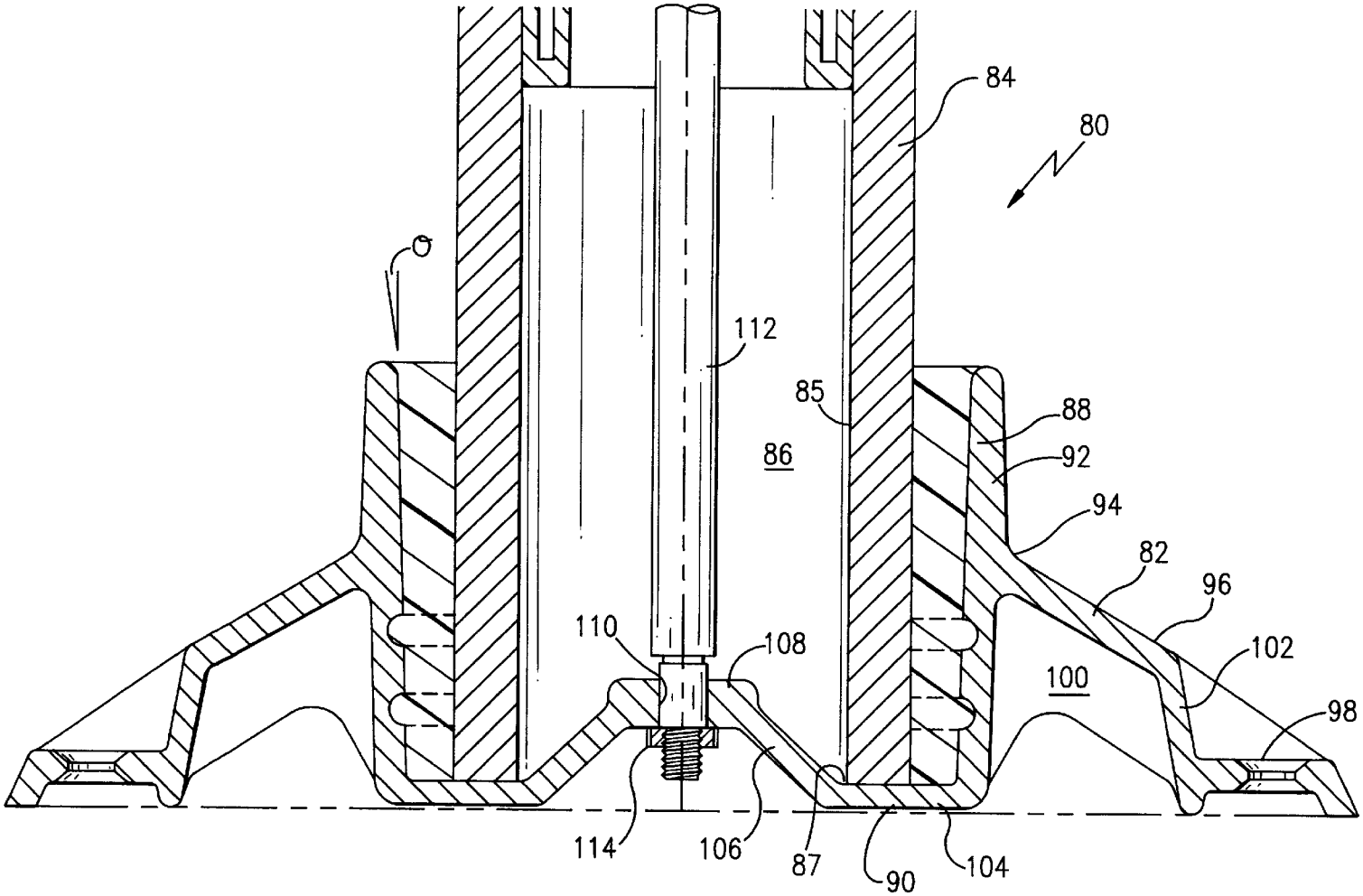
FIG. 4 shows a cut-away view of a second support stand embodiment of the present invention.

FIG. 4 shows an alternate support stand assembly 80 which is particularly suited for heavy duty applications. Support stand assembly 80 includes base member 82 and support rod 84 received in reception recess 86 formed by cup-shaped hub 88. Cup-shaped hub 88 represents a deviation from the embodiment of FIG. 1 of the present invention in that it includes bottom cap 90 joined to cylindrical hub section 92. Also, cylindrical hub section 92 extends out above the upper edge 94 of sloping external wall 96 of base member 82 which has a plurality of equally circumferentially spaced stepped shoulder openings 98 as in the embodiment of FIG. 1. The connection point of sloped wall 96 is preferably about at the halfway point of the cylindrical hub section 92. Ribs 100 extend radially between cylindrical hub section 92 and respective walls 102 positioned radially inward of fastener holes 98. Ribs 100 have an arched undersurface as in the earlier embodiment, but with a more triangular configuration giving a thicker integral hub section connection.

Figure 5:
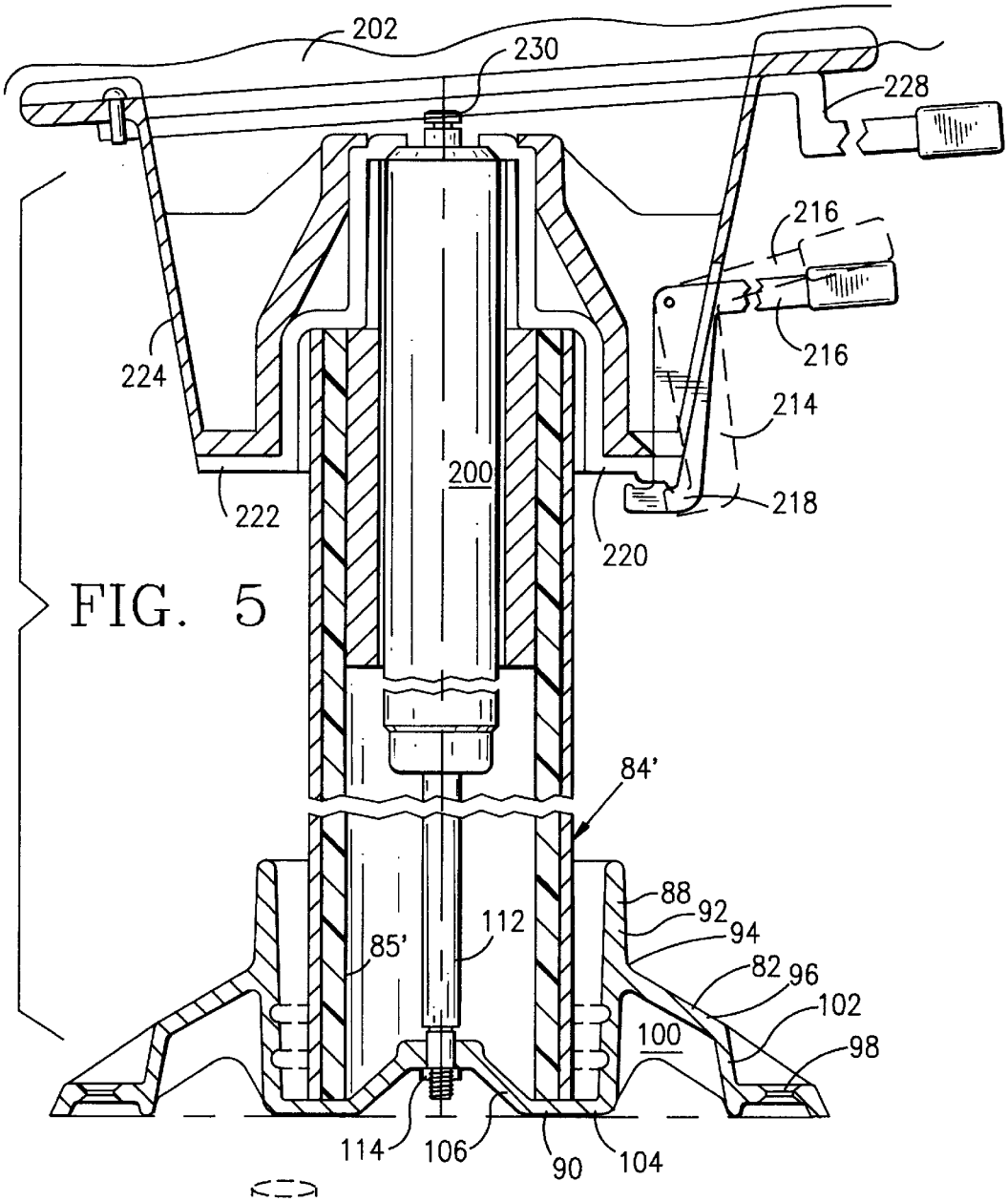
FIG. 5 shows a cut away view of the support stand of FIG. 4 together with a seat chair that is adjustable in height and rotatable with respect to the support stand.

Cap 90 features annular, flat support surface contact section 104, cone shaped intermediate section 106 and upper flat section 108. At the center of the circular flat section 108 is provided through hole 110 for receiving shaft 112. Shaft 112 passes through the interior of support rod 84 and is connected at its opposite end to a component supported at the upper end of support rod 84. FIG. 5 illustrates one possible embodiment wherein shaft 112 represents the lower shaft of a vertical air suspension system such as that described in U.S. patent application Ser. No. 09/127,848 entitled "Seat Assembly" which application is incorporated herein by reference. As shown in FIG. 5, shaft 112 extends to a movable piston assembly (not shown) sealed within air cylinder 200. Air cylinder 200 has relief valve 230 for allowing for vertical adjustment (e.g., a lowering of a seat when an operator sitting on the seat triggers valve 230 to allow for downward adjustment and the valve triggering also allowing for upward height adjustment due to the expansion of compressed air when a downward force is not imposed such as in the Power Rise® System of Springfield Marine Company of Nixa, Mo.).

FIG. 5 further shows rotation locking assembly 214 having a vertically pivoting handle member 216 with lower latch 218 which is received within slot 220 formed in a bottom, peripheral surface of end cap 222. End cap 222 is fixed from rotation with a projection/recess sleeve engagement made possible by a recess/protrusion sleeve on the exterior of the air cylinder casing and a corresponding recess/protrusion configuration in the interior surface of end cap 222, as described in the aforementioned patent application. Molded plastic seat mount 224, which supports seat 202, rests on end cap 222 such that it can freely pivot upon latch 218 being disengaged. Lever 228 is shifted along a slightly downward tapered, generally horizontal slot to trigger valve 230.

The threaded connection of shaft 112 to bottom cap 90 through bolt 114 provides for a stable positioning of support rod 84 with respect to cap member 90. Also, the diameter of the interior wall 85 (FIG. 4) of support rod 84 is preferably about the same as the diameter of the bottom circumferential end of sloping cone 106. In this way (whether an embodiment involves shaft 112 or not) support rod 84 is properly concentrically positioned with respect to cylindrical hub wall 92 since any misalignment will be obvious due to the tilting effect of the sloped wall of cone 106.

Figure 6:
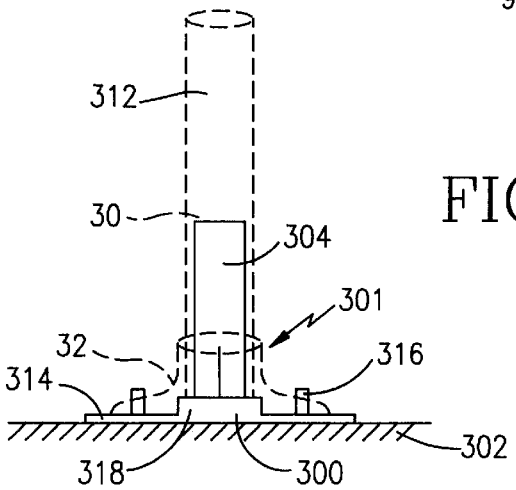
FIG. 6 shows a side elevational view of a jig assembly of the present invention.

For embodiments like that in FIGS. 1–3, wherein a position facilitating cone-shaped bottom end cap like 90 (with or without an attachment shaft 112) is not present, a positioning jig 301 can be used to help properly position the supporting rod in a concentric relationship within the operative defined by the hub's interior surface. One embodiment of such a jig is illustrated in FIG. 6. As shown in FIG. 6, base positioner 300 rests on underlying support rod 302 and includes a plurality of positioning pins 316 that extend up off of annular flange 314 of positioner 300. Pins 316 extend through relatively close tolerance holes 46 in base 32. Raised area 318 is also provided in base positioner 300 to compensate for the suspension of hub bottom edge 62 (FIG. 3) and the external base edge 64. Extending up from base 318 is cylindrical post 304 which has an outer diameter which is in close tolerance with the internal diameter of supporting rod 30 such that the supporting rod can be slid over post 304 in a light friction contact arrangement. Thus, with this arrangement proper positioning of supporting rod 30 with base 32 can be assured. Also, post 304 can be provided with a central threaded bolt for threaded reception in a complimentary thread hole in raised cylindrical area 318 and a set of different diameter posts with threaded bolt extension can be provided to accommodate different interior circumferences of the support rod for different sized embodiments of the support stand. Also, rather than a unitary arrangement between flange 314 and raised area 318, flange 314 can be an annular member that is slid over fixed raised area 318 with different pin patterns to compensate for different base design in different support stand embodiments. Alternatively, pins 316 can be releasably attached to flange 314 having multiple pin reception insert holes for different base designs. Once the base member and support rod are properly positioned on base 300, a concentric pour slot is formed between the exterior of the support rod and interior surface of the base member in which the yet to be cured adhesive and cushioning polymer is added. An annular groove seal (not shown) can be provided on raised area 318 for receiving the end of the supporting rod which prevents passage of liquid polymer and is preferably coated with a material or formed of a material that avoids polymer adhesion upon curing.

Although the present invention has been described with reference to preferred embodiments, the invention is not limited to the details thereof. Various substitutions and modifications will occur to those of ordinary skill in the art following a review of this application, and all such substitutions and modifications are intended to fall within the spirit and scope of the invention as defined in the appended claims.

What is claimed is:

1. A support stand, comprising:

a base having a reception area;

a supporting rod having a first end dimensioned for attachment to a supported object and a second end received within the reception area of said base;

an energy management member positioned between said supporting rod and said base, said energy management member being formed of a material which adheres said supporting rod to said base while providing a cushioning effect, and wherein said energy management member is bonded or adhered to said support rod and base through an adhesion arrangement brought about by a curing of a fluid polymer positioned between said supporting rod and base.

2. A support stand as recited in claim 1 wherein said energy management member is formed of an elastomeric material.

3. A support stand as recited in claim 2 wherein said elastomeric material is a urethane elastomer.

4. A support stand as recited in claim 3 wherein said urethane elastomer has a durometer value of from 80A to 97A.

5. A support stand as recited in claim 4 wherein said durometer value is 85A to 95A.

6. A support stand as recited in claim 2 wherein a durometer value of the elastomeric material is 85A to 95A.

7. A support stand as recited in claim 1 wherein said energy management member is an annular shaped member with one or more radially extending protrusions.

8. A support stand as recited in claim 1 wherein at least one of said supporting rod and base includes a depression or recess for receiving said fluid polymer and for providing an interlocking function upon curing and adhesion of said fluid polymer.

9. A support stand as recited in claim 8 wherein said depression includes an annular recess formed in at least one of said base and supporting rod.

10. A support stand as recited in claim 1 wherein said base includes a plurality of fastening holes for mounting said base to an underlying object.

11. A support stand as recited in claim 1 wherein said reception area in said base is defined by a hub having a side hub section and a bottom closure cap.

12. A support stand as recited in claim 11 wherein said supporting rod has an internal recess or aperture and said cap includes a cone section with an outer periphery commensurate with an internal periphery of the internal recess or aperture.

13. A support stand as recited in claim 12 wherein said cone section includes a fastening aperture in a central region thereof.

14. A support stand as recited in claim 1 wherein said reception area is defined by a through-hole in said base.

15. A support stand as recited in claim 1 wherein said energy management member is an annular elastomeric member that is positioned within an annular gap formed between said base and supporting rod and said annular gap has an average width of 0.20 to 0.40 of an inch (0.5 to 1.0 cm).

16. A support stand as recited in claim 15 wherein said gap is defined by a sloping wall of either or both of said supporting rod and base which sloping wall defines an enlarged upper area to facilitate the pouring of a liquid polymer.

17. A support stand assembly which comprises the support stand recited in claim 1 and a seat mount.

18. A support stand assembly as recited in claim 17 further comprising a vertical height adjustment system received within said supporting rod and connected to said base.

19. A support stand assembly which comprises the support stand recited in claim 1 and a table mount.

20. A method for assembling the support stand of claim 1, comprising positioning said supporting rod within the reception area of said base so as to form an annular gap therebetween and providing a fluid polymer within the gap and curing the fluid polymer so as to have the polymer bond or adhere to the supporting rod and base.

21. A method as recited in claim 20 wherein providing the polymer includes pouring liquid elastomeric material in said gap.

22. A method as recited in claim 21 wherein providing the polymer includes pouring liquid urethane material such that the urethane material flows within said gap and into a depression or aperture formed in one or both of said base and supporting rod so as to enhance axial locking of said supporting rod with respect to said base.

* * * * *